United States Patent [19]

Hendy et al.

[11] Patent Number: 4,571,832

[45] Date of Patent: Feb. 25, 1986

[54] MELON-SLICING APPARATUS WITH ADJUSTABLE GUIDE ROLLER

[76] Inventors: John Hendy; Vicki L. Hendy, both of P.O. Box 22022, San Bernardino, Calif. 92405

[21] Appl. No.: 629,669

[22] Filed: Jul. 11, 1984

Related U.S. Application Data

[63] Continuation-in-part of Ser. No. 423,261, Sep. 24, 1982, abandoned.

[51] Int. Cl.[4] ..... B26B 3/00

[52] U.S. Cl. ..... 30/280; 30/283

[58] Field of Search ..... 30/279 R, 280, 282–285, 30/301, 316, 121, 293, 294; 99/537, 538, 567

[56] References Cited

U.S. PATENT DOCUMENTS 850,871 4/1907 Nagasse ..... 30/280

1,939,283 12/1933 Shailer et al. ..... 30/283 X

FOREIGN PATENT DOCUMENTS 1092072 4/1955 France ..... 30/283

*Primary Examiner*—Douglas D. Watts

*Attorney, Agent, or Firm*—Armstrong, Nikaido, Marmelstein & Kubovcik

[57] ABSTRACT

A slicing apparatus including a handle, a curved continuous loop blade attached to the handle, and an adjustably positioned, rotatable roller. The positioning of the roller adjusts the depth of cut. The blade has a forward edge with a plurality of teeth and a plurality of V-shaped grooves extending into the blade adjacent the teeth while the rearward edge may be sharpened. Certain structure for the adjustability of the positioning of the roller is disclosed.

2 Claims, 8 Drawing Figures

MELON-SLICING APPARATUS WITH ADJUSTABLE GUIDE ROLLER

This application is a continuation-in-part of application Ser. No. 423,261 filed Sept. 24, 1982, now abandoned.

BACKGROUND OF THE INVENTION

The present invention relates to a cutting and slicing tool, and, more particularly, to an adjustable slicing and cleaning apparatus for various fruits including melons.

Melons, including cantaloupes, honeydew melons, and casaba melons, have an outer hard rind and an inner juicy flesh. At the center of these melons can be found seeds. In usual practice, the melon is sliced by a large straight knife into six or eight sectors. A spoon is used to scoop out the seeds. A smaller straight knife is used to slice the flesh away from the rind. This requires several different tools. Additionally, the smaller knife used to slide the flesh away from the rind is disadvantageous in that it has a straight blade and the portion to be cut from the rind is curved. Therefore, a portion of the flesh is usually wasted. Additionally, the skill of the operator determines the thickness and uniformity of the slices.

OBJECTS AND SUMMARY OF THE INVENTION

It is an object of the present invention to provide a single tool or apparatus for both scooping out the seeds of the melon and for slicing uniform slices from the rind.

It is a further object of the present invention to provide a tool or apparatus which is adjustable for differing thicknesses of slices as desired.

It is still a further object of the present invention to provide a tool or apparatus which is simple to use, easy to clean and simple to manufacture.

The above objects are obtained in a slicing apparatus comprising a handle, a curved continuous loop blade extending from the handle, and adjustable means mounted on the blade for regulating the depth of the cut by the blade. The blade may have a forward edge and a rearward edge with the forward edge having thereon a plurality of teeth and a plurality of V-shaped grooves extending into the blade adjacent the teeth. The rearward edge can also be sharpened.

For adjusting the depth of the cut of the blade, the blade can have a pair of parallel slots therein on opposite sides of the loop. Each slot has a lateral width and a plurality of matched circular openings spaced along the slot. Each circular opening has a diameter larger than the width of the slot. The adjustable means for regulating the depth can comprise a mounting means passing through both of the slots, a roller rotatably mounted on the mounting means, and means for retaining the mounting means at a position of one opposed pair of the circular openings.

In a first embodiment, the mounting means can comprise a pair of cylindrical mounting members, each of which has a large diameter portion and a small diameter portion. The large diameter portions are sized to be larger than the circular openings and to rotatably support the roller without excessive radial play. The small diameter portions are sized to be less than the width of the slot. The means for retaining them comprises a tapered transition portion on each cylindrical member between and joining the small diameter and the large diameter portions, a cylindrical bore in each of the large diameter portions, and a spring compressively received in the bores.

In a second embodiment, the mounting means can comprise a bolt.

The means for retaining can then comprise an expanded diameter portion on one end portion of the bolt, and adjustment keeper slideably mounted on an opposite end of the bolt having an outside diameter larger than the width of the slots and smaller than the diameter of the circular openings, a spring retainer cylinder fixed to the opposite end of the bolt and having an inner diameter larger than the outer diameter of the keeper, with the retainer cylinder having a length sufficient to extend over one end of the keeper opposite the blade, and a spring mounted in the retainer cylinder biasing the keeper towards the blade.

With such an apparatus, it is very simple to adjust the depth of the slice by moving the means for retaining out of the circular opening against the force of the spring. The asembly including the roller is then slid along the slot to the desired circular opening position. The mounting means is then released to have means for retaining rest in the desired circular openings.

The curved, slightly sharpened rearward edge of the blade can be used to scrape and scoop out the seeds and pulp from the central portion of the melon for complete cleaning. Thereafter, the opposite side of the blade having the teeth is used to slice the melon away from the rind in the desired thickness of slice. The apparatus can be used with smaller wedges of melon or with a half of a melon.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

The present invention comprises a curved, continuous loop blade 10 attached to a handle 20. The blade can be integrally formed with the handle. Alternatively, the blade may have handle portions 22 extending down the sides of the handle 20. The attachment of the handle portions 22 of the blade 10 to the handle 20 can be by any conventional means such as rivets, screws, glue, epoxy, integral molding or the like.

Figure 1:
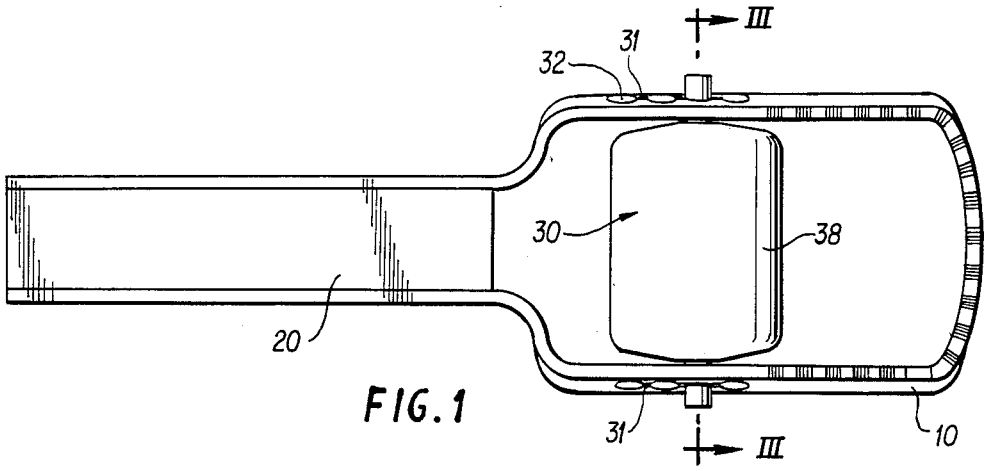
FIG. 1 shows a plan view of the first embodiment of the present invention.
Figure 2:
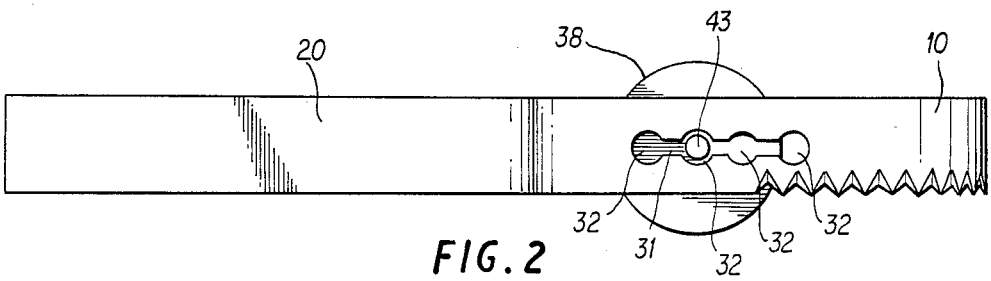
FIG. 2 shows a side view thereof.
Figure 3:
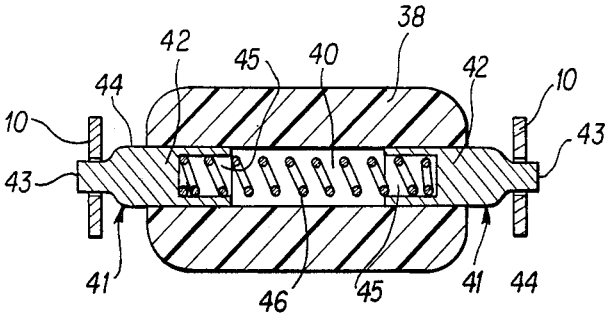
FIG. 3 shows a cross-sectional view of the first embodiment taken along lines III—III of FIG. 1.
Figure 4:
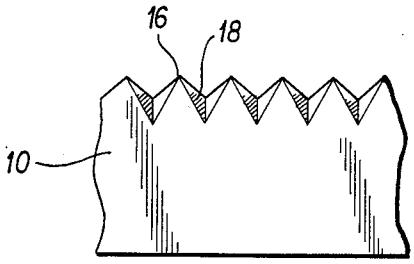
FIG. 4 shows a partial lateral view of one portion of the blade of the present invention.
Figure 5:
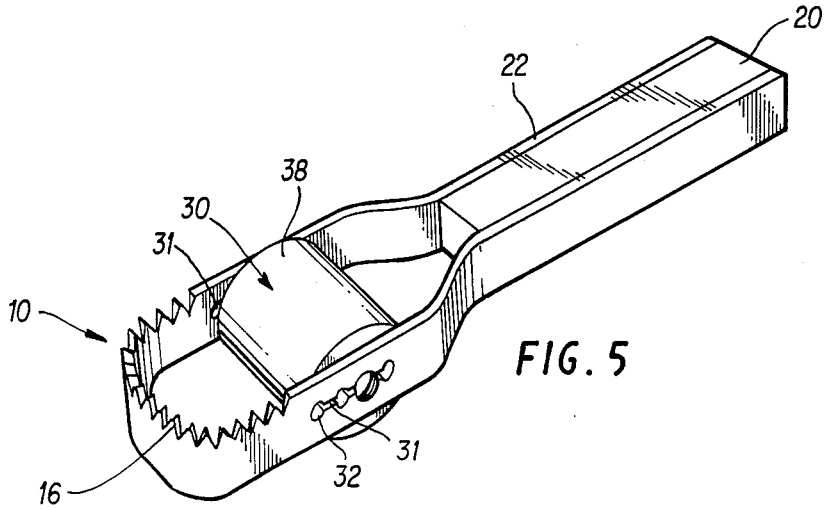
FIG. 5 shows a perspective view of a second embodiment of the present invention.
Figure 6:
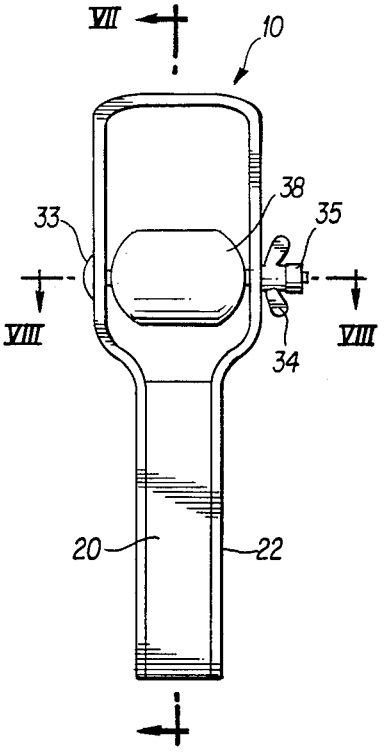
FIG. 6 shows a plan view of the second embodiment.
Figure 7:
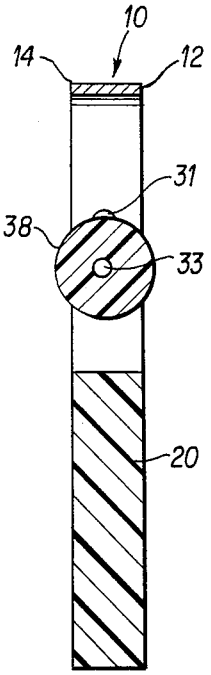
FIG. 7 shows a cross-section of the second embodiment taken along lines VII—VII of FIG. 6.

The blade 10 has a forward edge 12 and a rearward edge 14. The rearward edge may be blunt, slightly sharpened, or extremely sharpened. The forward edge 12 has serrated teeth 16 thereon (FIG. 4). Each pair of teeth 16 can have a groove 18 therebetween. The V-shaped grooves 18 between each tooth 16 of the forward edge 12 assist in the cutting of the blade towards the melon rind and prevent gouging of the rind and sticking of the blade against the melon flesh.

The apparatus includes an adjustable means 30 mounted on the blade for regulating the depth of cut by the blade. To this end, blade 10 has a pair of slots 31 on opposite sides of the loop. Each slot 31 has a plurality of circular openings 32 therein. Each circular opening 32 has a diameter larger than the width of the slot 31.

The adjustable means 30 can in the first embodiment comprise mounting means 40 passing through both matched slots 31. A roller 38 is rotatably mounted on the mounting means 40. The mounting means 40 can comprise a pair of cylindrical mounting members 40, each having a larger diameter portion 42 and a small diameter portion 43. The large diameter portions 42 are sized to be larger than the circular openings 32 so that it can not pass therethrough. Also the large diameter portions are sized to rotatably support the roller 38 with minimal radial play thereof. The small diameter portions 43 are sized to have a small diameter than the lateral width of the slots 31.

Means are provided for retaining the mounting members 41 at a position of one opposed pair of openings 32. This means, preferrably, comprises a tapered transition portion 44 on each mounting member 41 between and joining the respective small diameter portion 43 and the large diameter portion 42. Each mounting member 41 has a cylindrical, open end bore 45 in the large diameter portion 42 thereof. A spring 46 is compressively received in the opposed bores 45 of the members 41 when assembled in the roller 38. Since the smaller diameter portion 43 is smaller than the slot width and the large diameter portion 42 is larger than the circular openings 31, squeezing of the two small diameter portions towards each other enables the adjustment means 30 including roller 38 to be moved longitudinally of the blade along the slot 31. Release of the members 41 enables the spring 46 to bias the members outwardly so that the tapered transition portions 44 engage in an opposed pair of the circular openings 32.

Figure 8:
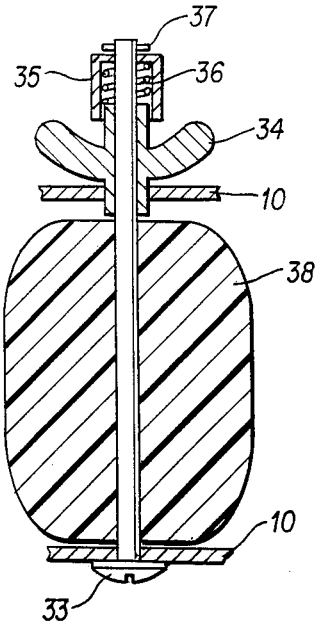
FIG. 8 shows a cross-section view of the second embodiment taken along lines VIII—VIII of FIG. 6.

The adjustable means 30 can alternatively comprise a bolt 33 pasing through both slots 31 (FIG. 8). The bolt 33 has a diameter smaller than the width of the slots 31. A roller 38 is rotatably mounted on the bolt 33. A means is provided for retaining the bolt at a position of one opposed pair of the circular openings 32.

This means can include a conventional nut and locknut.

However, the means for retaining the bolt 33 at a position of one pair of the circular openings 32 can also comprise an expanded diameter portion on one end of the bolt 33 (FIG. 8).

This can be simply provided by having the bolt 33 be a carriage-type bolt. An adjustment keeper 34 is slideably mounted on an opposite end of the bolt and has an outer diameter adjacent the blade larger than the width of the slots and smaller than the diameter of the circular openings. The adjustment keeper can have a pair of arms thereon or alternatively, can have a conical expanding portion or in other means to make the adjustment keeper readily graspable. A spring retainer cylinder 35 is fixed to the opposite end of the bolt, for example, by a clip 37. The retainer cylinder has an inner diameter larger than the outer diameter of the keeper and a length sufficient to extend over one end of the keeper opposite the blade. A helical spring 36 can be mounted in the retainer cylinder by biasing the keeper towards the blade. The purpose of the retainer cylinder having a length sufficient to extend over one end of the keeper in a diameter larger than the outer diameter of the keeper is to simply and easily retain the spring inside the retainer cylinder.

In use, the melon to be sliced is cut at least in half. The present invention is held by the handle portion and the rearward edge 14 is utilized to scoop out the seeds and pulp at the center of the melon. Thereafter, the present invention is turned over, the particular depth desired is set on the means for regulating the depth of cut.

In the second embodiment, this is accomplished by pulling the adjustment keeper 34 against the biasing of the spring 36 so that the end of the adjustment keeper 34 nearest the blade is pulled out from the circular opening 32 in which it presently resides. With placing a thumb on the end of the bolt adjacent the keeper, the expanded diameter portion of the bolt 33 can be lifted from the associated circular opening 32 on the opposite side of the blade. Since the diameter of the bolt is less than the with of the slot, the bolt can be easily slide down to the desired circular opening corresponding to the depth of slice desired.

Thereafter, the adjustment keeper 34 is released, the expanded diameter portion of the bolt rests in one circular opening and the adjustment keeper 34 rests in the opposite matching circular opening.

The forward edge 12 of the blade having the teeth 16 is utilized to slice out the slices. The rotatable roller 38 adjusts the depth of the slice by its position and the distance between it and the blade.

The present invention may be used on many different fruits including cantaloupes, honeydew melons, casaba melons, watermelon, banana squash, zucchini squash, and pineapple. If the melon or other fruit is less than fully ripe, the roller can be set closer to the portion of the blade opposite the handle to cut out only the more ripened central portion.

The handle 20 may be made of plastic, wood, or any other suitable material. The blade 10 may be made of plastic, steel, stainless steel, or any other suitable material. The roller 38 may be made of plastic or wood or other suitable material. The cylindrical mounting members may be made of plastic, metal or other suitable material. The adjustment keeper may be made of metal or plastic. The particular dimensions of each of the parts of the present invention are not critical except as herein above noted with respect to certain of the relationships.

It is readily apparent that the above-described melon slicing apparatus meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A slicing apparatus comprising:

a handle, a curved continuous loop blade extending from said handle, said blade having a pair of parallel slots therein on opposite ides of said loop, said slots having a lateral width and a plurality of matched circular openings spaced along said slot, each circular opening having a diameter larger than said width, and adjustable means mounted on said blade for regulating the depth of cut by said blade which includes mounting means passing through both of the slots, a roller rotatably mounted on said mounting means, and spring-loaded means for retaining said mounting means at a position of one opposed pair of said circular openings, said mounting means comprising a bolt; said means for retaining comprising an expanded diameter portion in one end portion of said bolt, an adjustment keeper slideably mounted on an opposite end of said bolt having an outer diameter larger than said width of said slots and smaller than said diameter of said circular openings, a spring retainer cylinder fixed to said opposite end of said bolt and having an inner diameter larger than said outer diameter of said keeper, said retainer cylinder having a length sufficient to extend over one end of said keeper opposite said blade, and a spring mounted in said retainer cylinder biasing said keeper towards said blade.

2. A slicing apparatus comprising:

a handle, a curved continuous loop blade extending from said handle, said blade having a pair of parallel slots therein on opposite sides of said loop, said slots having a lateral width and a plurality of matched circular openings spaced along said slot, each circular opening having a diameter larger than said width, and adjustable means mounted on said blade for regulating the depth of cut by said blade which includes mounting means passing through both of the slots, a roller rotatably mounted on said mounting means, and spring-loaded means for retaining said mounting means at a position of one opposed pair of said circular openings, said mounting means comprising a pair of cylindrical mounting members, each having a large diameter portion and a small diameter portion, said large diameter portions being sized to be larger than the diameter of said circular openings and to rotatably support said roller with minimal radial play, said small diameter portions being sized to be less than said width of said slot; said means for retaining comprising a tapered transition portion on each cylindrical member between and joining said small diameter and said large diameter portions, a cylindrical bore in each of the large diameter portions, and a spring compressively received in the bores.

* * * * *